US010934742B2

(12) United States Patent
Parisien

(10) Patent No.: US 10,934,742 B2
(45) Date of Patent: Mar. 2, 2021

(54) INTERLOCKING FENCE PANELS

(71) Applicant: Harvey Parisien, Ottawa (CA)

(72) Inventor: Harvey Parisien, Ottawa (CA)

( * ) Notice: Subject to any disclaimer, the term of this patent is extended or adjusted under 35 U.S.C. 154(b) by 55 days.

(21) Appl. No.: 15/614,084

(22) Filed: Jun. 5, 2017

(65) Prior Publication Data

US 2018/0058092 A1 Mar. 1, 2018

(51) Int. Cl.
*E04H 17/16* (2006.01)
*E04H 17/14* (2006.01)
*E04H 17/22* (2006.01)

(52) U.S. Cl.
CPC ..... *E04H 17/1413* (2013.01); *E04H 17/1421* (2013.01); *E04H 17/22* (2013.01); *E04H 2017/1465* (2013.01); *E04H 2017/1491* (2013.01)

(58) Field of Classification Search
CPC . E04H 17/16; E04H 17/168; E04F 2201/0115
USPC ..... 256/24
See application file for complete search history.

(56) References Cited

U.S. PATENT DOCUMENTS 855,030 A * 5/1907 Wemlinger, Jr. ..... E02D 5/04 405/278
1,012,124 A * 12/1911 Conklin ..... E02D 5/04 198/850
1,330,240 A * 2/1920 Conkling ..... E02D 5/04 405/278
1,543,676 A * 6/1925 Lindenlauf ..... E02D 5/08 405/278
1,590,301 A * 6/1926 Lindenlauf ..... E02D 5/04 405/278
3,191,724 A * 6/1965 De Ridder ..... E04C 2/08 428/119
4,306,631 A * 12/1981 Reusser ..... E01F 8/0035 181/210
4,316,351 A * 2/1982 Ting ..... E04C 2/292 52/309.9
5,149,061 A * 9/1992 Borgnini ..... E01F 7/06 256/13.1
5,165,213 A * 11/1992 Finch ..... E04B 2/721 52/520
5,474,279 A * 12/1995 Parisien ..... E01F 8/0011 256/24
5,904,343 A * 5/1999 Parth ..... E04C 2/20 256/19
5,921,716 A * 7/1999 Wickberg ..... E02D 5/02 405/278
6,715,736 B2 * 4/2004 Cummings ..... E04H 17/1443 256/24
6,715,964 B2 * 4/2004 Nottingham ..... E02D 5/02 405/278
8,167,515 B2 * 5/2012 Hermes ..... E02D 5/04 405/276

(Continued)

*Primary Examiner* — Joshua T Kennedy

(57) ABSTRACT

Interlocking fence panels for interconnection between horizontal channeled rails in a fence system, and, more particularly, to improved interlocking fence panel members which can interconnect for insertion between horizontal channeled rails to provide a one-piece continuous infill effect between these horizontal channeled rails in a fence system which, when interconnected with other panels and in place, will not become disengaged from one another and which will strengthen the stability and integrity of the fence system itself.

14 Claims, 6 Drawing Sheets

(56) References Cited

U.S. PATENT DOCUMENTS 8,210,503 B2 * 7/2012 Garrison ..... E04H 17/16
256/24

* cited by examiner

INTERLOCKING FENCE PANELS

The present invention relates to interlocking fence panels for interconnection between horizontal channeled rails in a fence system, and, more particularly, to improved interlocking fence panel members which can interconnect for insertion between horizontal channeled rails in a fence system which, when interconnected and in place, will not become disengaged from one another between the horizontal channeled rails and which will strengthen the stability and integrity of the fence system itself.

BACKGROUND OF THE INVENTION

When installing a fence system, there can typically be a plurality of posts with horizontal channeled rails spanned therebetween for receiving and containing therein fence infill, or, more particularly, interconnected fence panel members.

However, it is not uncommon for such typical conventional fence systems, and the fence panels therein, to become separated or disengaged from one another over time having regard to, for example, erosion, and/or rotting when exposed to weather conditions, which can weaken and compromise the stability and ultimate integrity of the fence system itself.

It would therefore be advantageous to provide improved interlocking fence paneling for interconnection between horizontal channeled rails in a fence system, which provides a one-piece continuous infill effect between these horizontal channeled rails.

It would also be advantageous to have provide improved interlocking fence paneling members for interconnection between horizontal channeled rails in a fence system which, when interconnected and in place between the horizontal channeled rails, will not become disengaged from one another and which will strengthen the stability and integrity of the fence system itself. To this end, the present invention effectively addresses these needs.

SUMMARY OF THE INVENTION

The present invention provides the advantage of improved interlocking fence paneling for interconnection between horizontal channeled rails in a fence system, which provides a one-piece continuous infill effect between these horizontal channeled rails.

The present invention also provides the advantage of improved interlocking fence paneling members for interconnection between horizontal channeled in a fence system which, when interconnected and in place therebetween, will not become disengaged from one another and which will strengthen the stability and integrity of the fence system itself.

According to a broad aspect of an embodiment of the present invention, there is disclosed a fence panel for interconnection with adjacent panels for placement between horizontal top rails and bottom rails of a fence system, the panel comprising a body portion; biasingly movable end portions at opposed ends of the body portion; and locking members connected to the body portion, and proximate to the end portions thereof, for securing interconnection with the adjacent panels, the locking members and the end portions defining a groove therebetween for receiving locking members of the adjacent panels.

According to another broad aspect of an embodiment of the present invention, there is disclosed a plurality of interconnected fence panels for use in a fence system comprising horizontal top rails and bottom rails extending alongside fence posts, the top and the bottom rails having channels therein, each of the panels having end edges inserted and received in grooves of adjacent panels, and having upper and bottom edges of the panels received in the channels of the top rails and the bottom rails, wherein the grooves of each of the panels biasingly move to accommodate the end edges of the adjacent panels when insertion initially occurs, and then biasingly retract back to their original position to secure and lock interconnection of the adjacent panels when the interconnection of the adjacent panels is completed.

According to another aspect of the present invention, there is provided a method for manufacturing a fence panel constructed and arranged for interconnection with adjacent panels for placement between horizontal top rails and bottom rails of a fence system, the method comprising providing a body portion; providing biasingly movable end portions at opposed ends of the body portion; and providing locking members connected to the body portion, and proximate to the end portions thereof, for securing interconnection with the adjacent panels, the locking members and the end portions defining a groove therebetween for receiving locking members of the adjacent panels.

BRIEF DESCRIPTION OF THE DRAWINGS

The embodiments of the present invention will now be described by reference to the following figures, in which identical reference numerals in different figures indicate identical elements and in which.

DETAILED DESCRIPTION OF THE INVENTION

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

Figure 1:
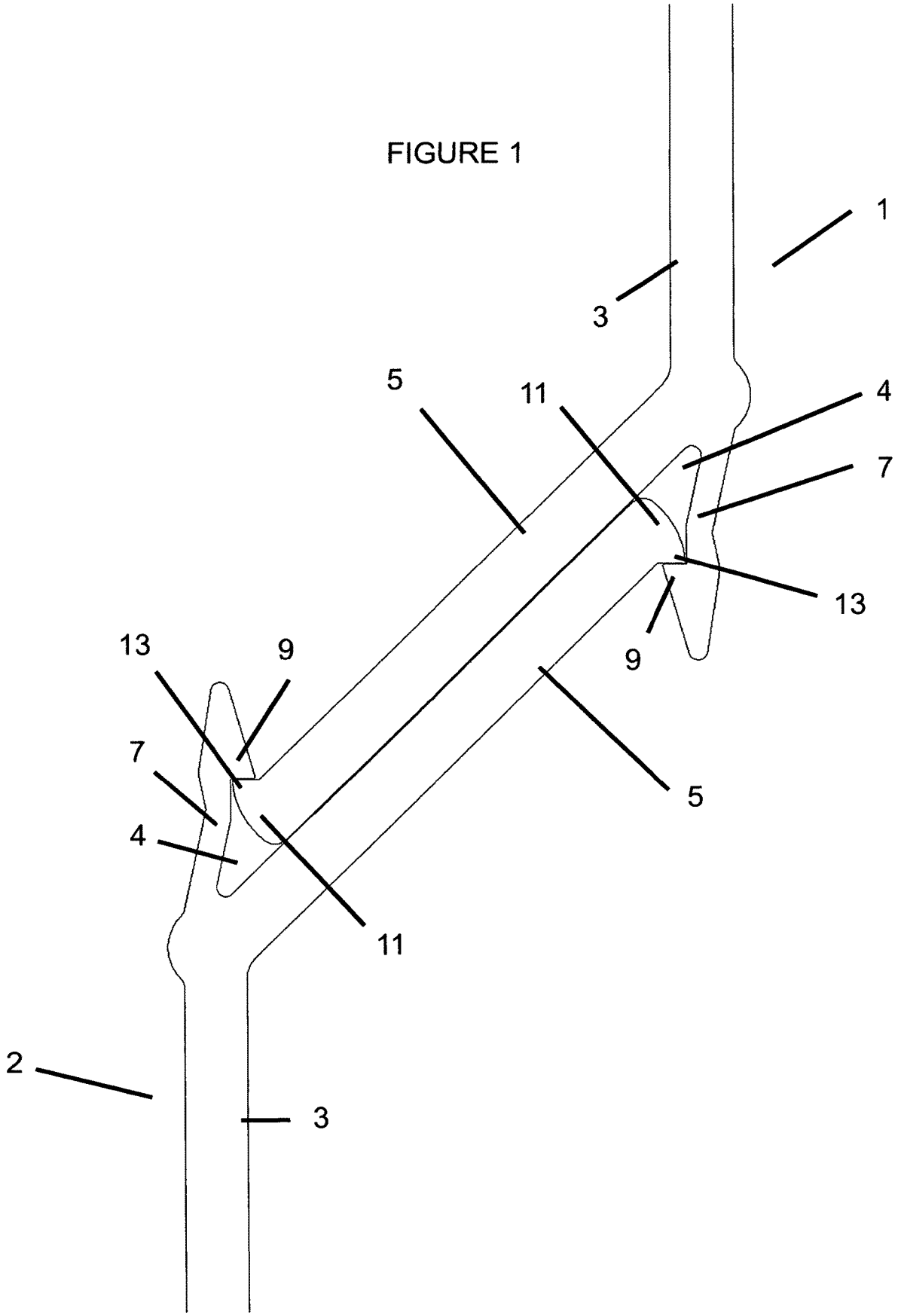
FIG. 1 is a cutaway top view of the interlocking fence panels of the present invention.

The present invention consists of improved interlocking fence panel members which can interconnect for insertion between horizontal channeled rails in a fence system which, when interconnected and in place, will not become disengaged from one another between the horizontal channeled rails and which will strengthen the stability and integrity of the fence system itself. Referring to FIG. 1, there is shown a fence panel, shown generally at 1 in accordance with a first exemplary embodiment of the present invention, which can be interlocked with at least one other adjacent fence panel member 2.

In this embodiment, as hereinafter described, the fence panel 1, possesses a body portion 3, at opposed ends of which are biasingly movable end portions 7 that are integrally connected thereto. In an exemplary embodiment, the end portions 7 have a smaller circumference than a circumference of the body portion 3, as can be seen in FIG. 1, and the end portions 7 have a lipped portion 9 on a side thereof.

The body portion 3 of each panel will also possess at opposed ends thereof, a locking member 5 connected to the body portion which is, in an exemplary embodiment, proximate to the end portions 7 thereof, for securing interconnection with an adjacent panel 2. As can be seen in FIG. 1, the locking members 5 and the end portions 7 of each panel define a groove 4 therebetween for receiving the locking member 5 of an adjacent panel when interconnection of panels is desired.

The locking members 5 on each panel possess a bulbous nose portion 11 on an end thereof, and a hooked portion 13 on the side of this end portion of the locking member 5. In an exemplary embodiment, the locking members 5 are integrally connected to the body portion 3 at an angled relationship thereto, which can be clearly seen in FIG. 1.

Figure 2:
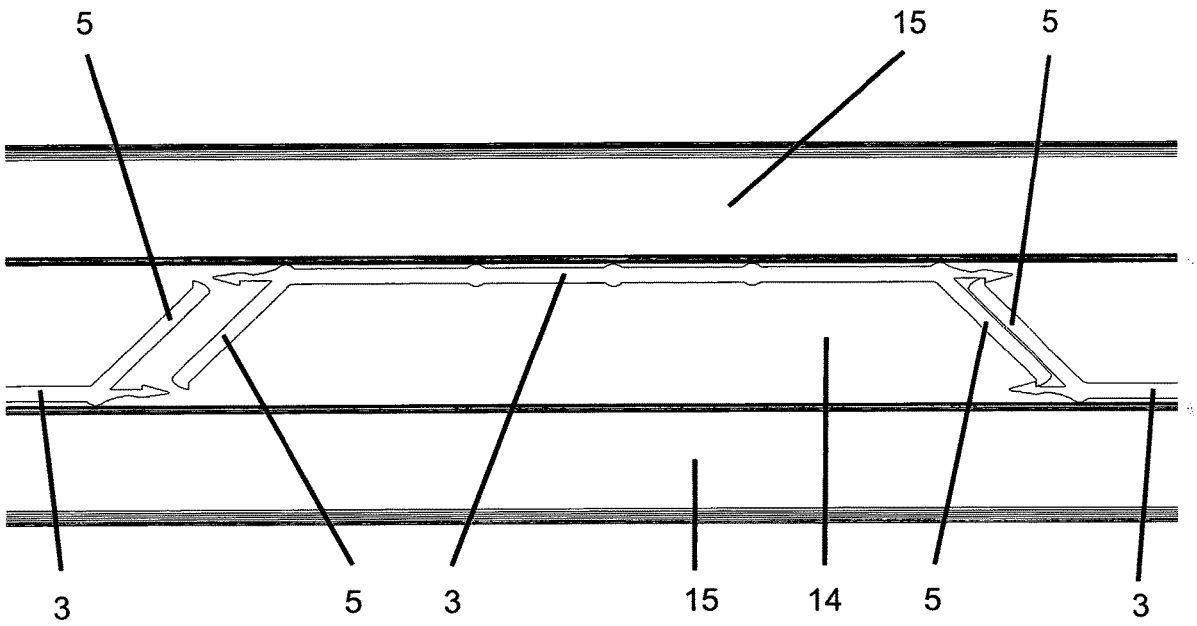
FIG. 2 is a top view of the interconnected interlocking fence panels shown in FIG. 1.

With reference again to FIG. 1, when interconnection of a panel 1 with an adjacent panel 2 is to occur, the locking member 5 of a panel is positioned to enter into groove 4. In doing so, bulbous nose portion 11 encounters and contacts the lipped portion 9 of the end portion 7 of an adjacent panel. As further pressure is applied in the interconnection process, the lipped portion 9 (and correspondingly, the end portion 7) biasingly moves to accommodate nose portion 11, and allow the locking member 5 to be received within the groove 4. Once the nose portion 11 is clear of the lipped portion 9, then the lipped portion 9 (and correspondingly, the end portion 7) biasingly retracts to its original position, whereby the hooked portion 13 of the locking member 5 is then contacted and secured in place by the lipped portion 9 on the end portion 7 of the adjacent panel. Several such interconnected panels can be seen in FIG. 2, the panels being shown positioned within a channel 14 of a lower horizontal channeled rail 15.

Figure 3:
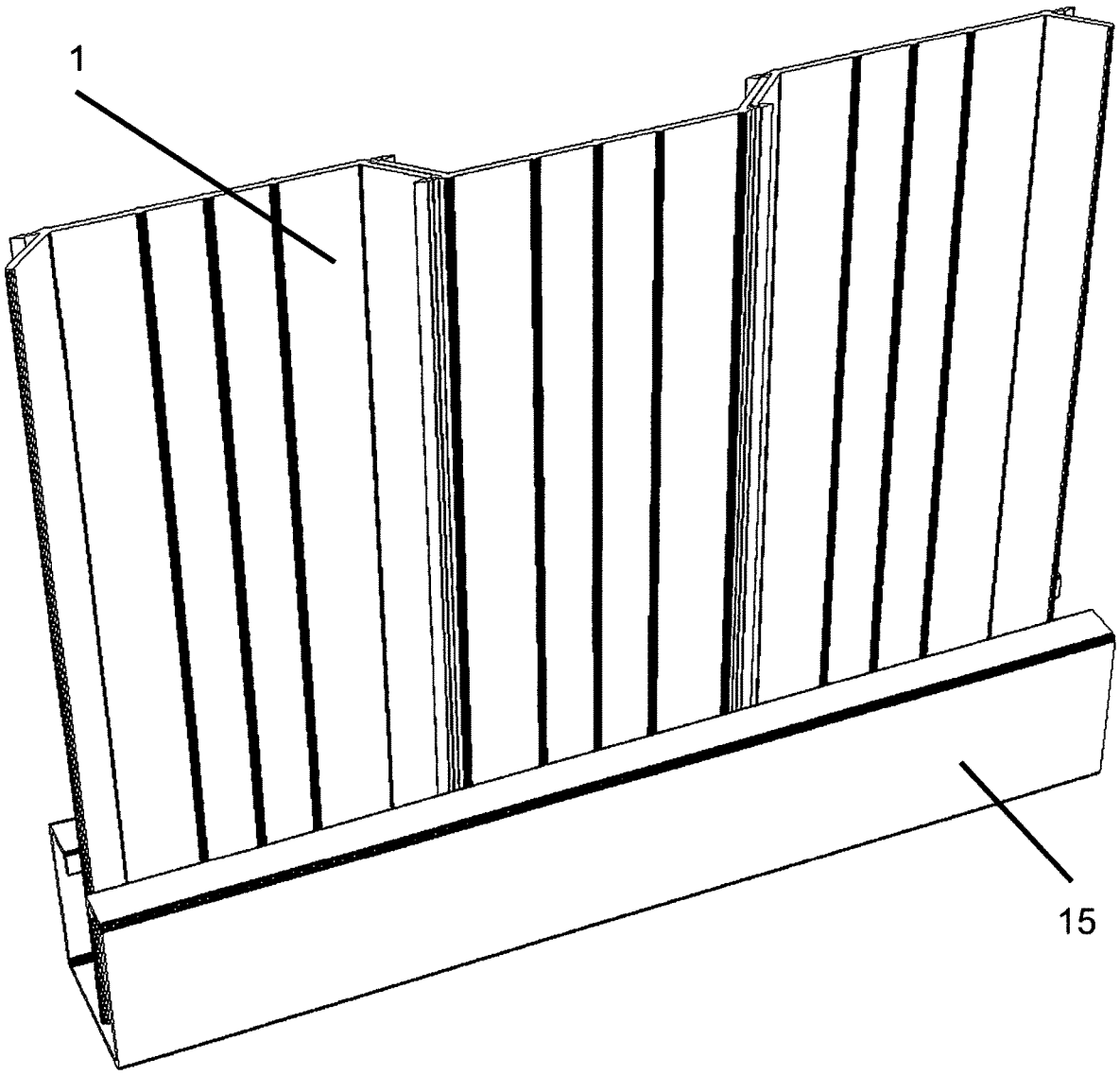
FIG. 3 is a side perspective view of the interconnected interlocking fence panels shown in FIG. 2, illustrating the panel members positioned within the horizontal channeled bottom rail in a fence system.
Figure 4:
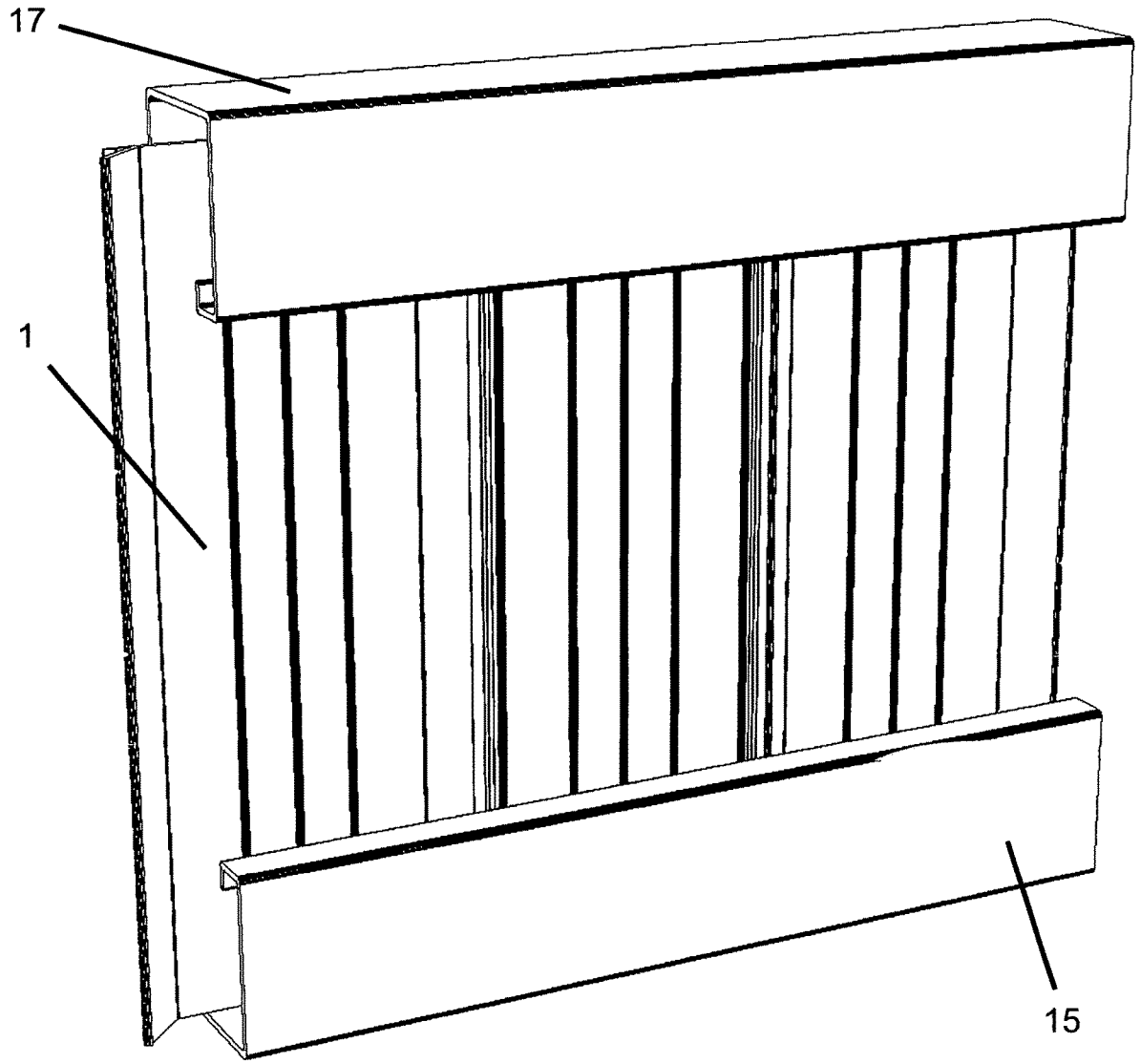
FIG. 4 is a side perspective view of the interconnected interlocking fence panels shown in FIG. 2, illustrating the interconnected panel members positioned between the horizontal channeled upper rail and bottom rail in a fence system.
Figure 5:
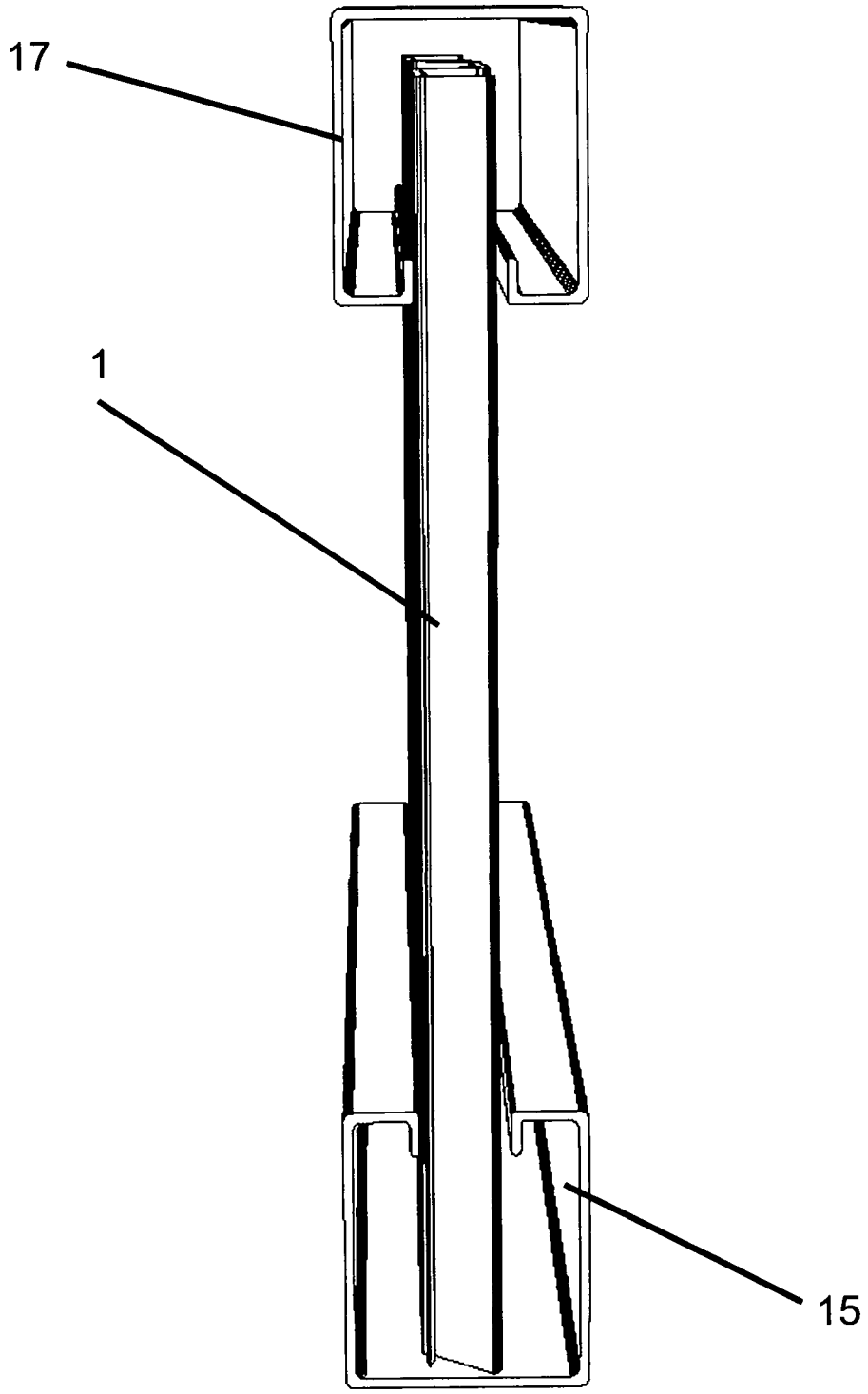
FIG. 5 is an end perspective view of the interconnected interlocking fence panels shown in FIG. 4, illustrating the interconnected panel members positioned between the horizontal channeled upper rail and bottom rail in a fence system.
Figure 6:
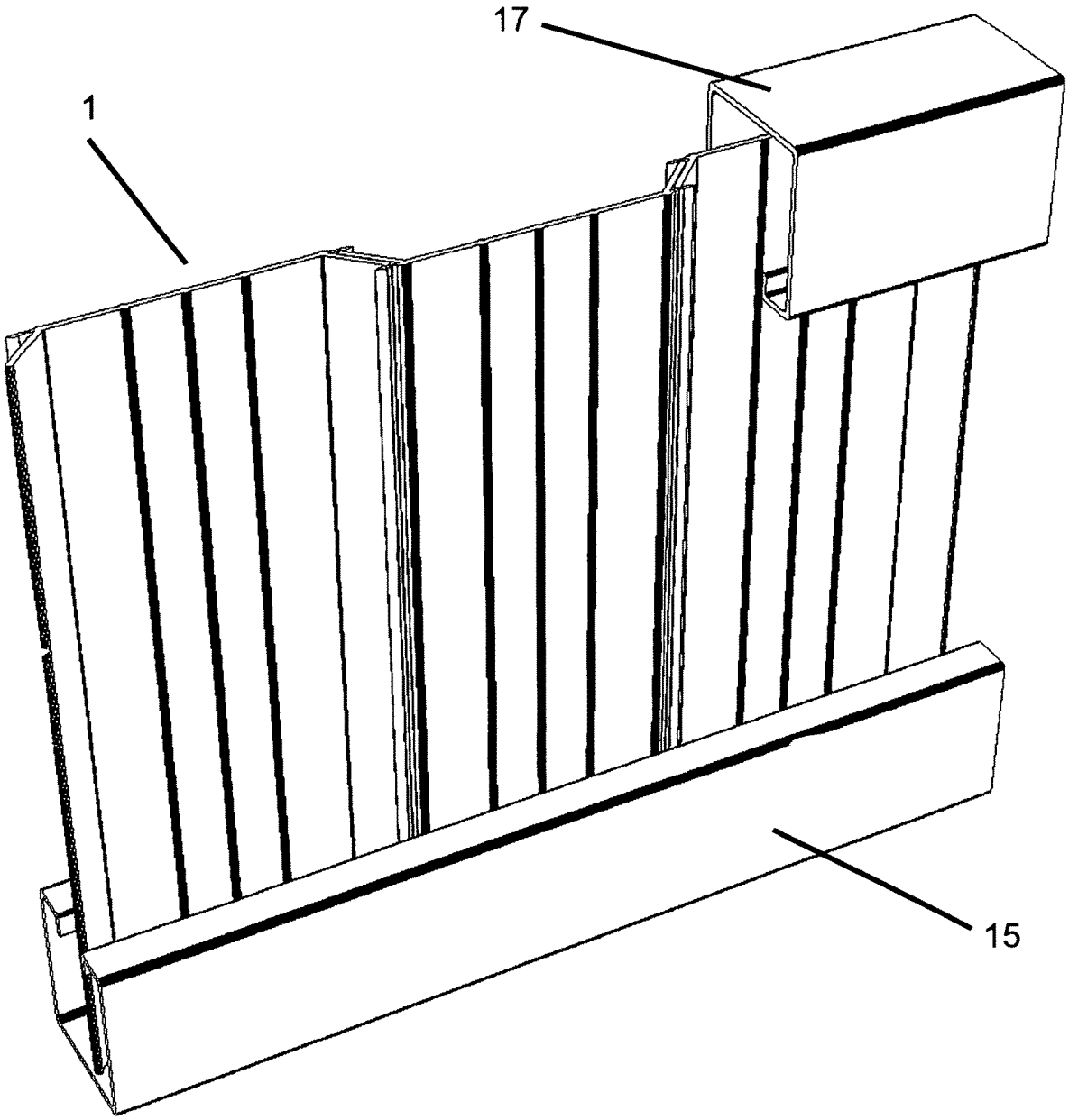
FIG. 6 is a side perspective view of the interconnected interlocking fence panels shown in FIG. 2, illustrating the interconnected panel members positioned between the horizontal channeled upper rail and bottom rail in a fence system, the horizontal channeled upper rail in FIG. 6 being shown in cutaway view.

In positioning such interconnected panels in a fence system having horizontal channeled rails, FIG. 3 illustrates how a panel 1, is interconnected with other panels so as to form a one-piece continuous infill sheet of material, bottom edges of which are initially inserted within a lower horizontal channeled rail 15 of the fence system. An upper horizontal channeled rail 17, as shown in FIGS. 4, 5 and 6, is then positioned on top of the interconnected panels. In this manner, once the panels are secured and positioned between the lower horizontal channeled rail 15 and the upper horizontal channeled rail 17, they will not become disengaged from one another between these rails and will strengthen the stability and integrity of the fence system itself. Disengagement of the panels from one another can only occur if the upper horizontal channeled rail 17 of the fence system is removed, and the panels being manually separated from one another.

In an exemplary embodiment, the panels are comprised of aluminum extrusion material, though it will be understood that there could be numerous variations that could be utilized, as would be readily apparent to one skilled in the art. For example, such extrusion material could comprise, but is not limited to, plastic PVC or various composites.

It will be apparent to those skilled in this art that various modifications and variations may be made to the embodiments disclosed herein. Other embodiments consistent with the present invention will become apparent from consideration of the specification and the practice of the invention disclosed therein.

Accordingly, the specification and the embodiments are to be considered exemplary only, with a true scope of the invention being disclosed by the following claims.

I claim:

1. A fence panel for interconnection with adjacent panels for placement between horizontal top rails and bottom rails of a fence system, the panel comprising:

a body portion extending in a horizontal direction;

biasingly movable end portions extending from opposed ends of the body portion generally in the same horizontal direction for securing interconnection with the adjacent panels; and locking members connected to the body portion, and extending from the end portions thereof, the locking members and the end portions defining a groove therebetween whereby, when adjacent panels are slid in the longitudinal direction, a nose portion located on an end of the locking members biasingly moves the end portions laterally to allow the locking members to be received in the groove, the end portions then retracting once interconnection is complete to positively secure the locking members in the groove, the fence panel being configured to be horizontally inserted within a top and a bottom rail and interconnected with an adjacent panel without disassembly of the fence system.

2. The fence panel of claim 1, wherein the end portions possess a smaller thickness than a thickness of the body portion.

3. The fence panel of claim 1, wherein the end portions have a lipped portion on a side thereof.

4. The fence panel of claim 1, wherein each of the locking members are connected to the body portion at an angled relationship thereto.

5. The fence panel of claim 1, wherein each of the locking members further comprise a hooked portion on the side of the end.

6. The fence panel of claim 1, wherein the panel is comprised of aluminum extrusion material.

7. A plurality of interconnected fence panels for use in a fence system comprising horizontal top rails and bottom rails extending alongside fence posts, the top and the bottom rails having channels therein, each of the panels having end edges inserted and received in grooves of adjacent panels, and having upper and bottom edges of the panels received in the channels of the top rails and the bottom rails, wherein each panel comprises:

a body portion extending in a horizontal direction;

biasingly movable end portions extending from opposed ends of the body portion generally in the same horizontal direction for securing interconnection with the adjacent panels; and locking members connected to the body portion, and extending from the end portions thereof, the locking members and the end portions defining a groove therebetween whereby, when adjacent panels are slid in the longitudinal direction, a nose portion located on an end of the locking members biasingly moves the end portions laterally to allow the locking members to be received in the groove, the end portions then retracting once interconnection is complete to positively secure the locking members in the groove, the fence panel being configured to be horizontally inserted within the top and bottom rails and interconnected with an adjacent panel without disassembly of the fence system.

8. The fence panels of claim 7, wherein the panels are comprised of aluminum extrusion material.

9. A method for manufacturing a fence panel constructed and arranged for interconnection with adjacent panels for placement between horizontal top rails and bottom rails of a fence system, the method comprising:

providing a body;

portion extending in a horizontal direction;

providing biasingly movable end portions extending from opposed ends of the body portion generally in the same horizontal direction for securing interconnection with the adjacent panels; and providing locking members connected to the body portion, and extending from the end portions thereof, the locking members and the end portions defining a groove therebetween whereby, when adjacent panels are slid in the longitudinal direction, a nose portion located on an end of the locking members biasingly moves the end portions laterally to allow the locking members to be received in the groove, the end portions then retracting once interconnection is complete to positively secure the locking members in the groove, the fence panel being configured to be horizontally inserted within the top and bottom rails and interconnected with an adjacent panel without disassembly of the fence system.

10. The method for manufacturing a fence panel of claim 9, further comprising the step of providing the end portions with a smaller thickness than that of a thickness of the body portion.

11. The method for manufacturing a fence panel of claim 9, further comprising the step of providing the end portions with a lipped portion on a side thereof, for securing and locking in place locking members of the adjacent panels when the locking members of the adjacent panels are positioned within the groove.

12. The method for manufacturing a fence panel of claim 9, further comprising the step of manufacturing the panel from aluminum extrusion material.

13. The method for manufacturing a fence panel of claim 9, further comprising the step of positioning the locking members on the body portion at an angled relationship thereto.

14. The method for manufacturing a fence panel of claim 9, further comprising the step of providing each of the locking members with a hooked portion on a side of the ends.

* * * * *